US006398018B1

(12) United States Patent
Livesley et al.

(10) Patent No.: US 6,398,018 B1
(45) Date of Patent: Jun. 4, 2002

(54) CONTAINER

(75) Inventors: David John Livesley, Elsworth; William Frank Tyldesley, Diss; Christopher Andrew Townsend, Bracknell, all of (GB)

(73) Assignee: Ocular Sciences, Inc., Concord, CA (US)

( * ) Notice: Subject to any disclaimer, the term of this patent is extended or adjusted under 35 U.S.C. 154(b) by 0 days.

(21) Appl. No.: 09/492,493

(22) Filed: Jan. 27, 2000

Related U.S. Application Data

(63) Continuation of application No. PCT/GB98/02226, filed on Jul. 27, 1998.

(30) Foreign Application Priority Data

Jul. 30, 1997 (GB) ..... 9716118

(51) Int. Cl.[7] ..... B65D 81/22
(52) U.S. Cl. ..... 206/210; 206/5.1; 220/501
(58) Field of Search ..... 134/901; 206/5.1, 206/210, 361; 220/501

(56) References Cited

U.S. PATENT DOCUMENTS

| | | | | | |
|---|---|---|---|---|---|
| 3,211,503 | A | | 10/1965 | Barnes | |
| 3,394,717 | A | * | 7/1968 | Hollinger | 206/5.1 |
| 3,759,375 | A | * | 9/1973 | Nappi | 206/361 |
| 4,337,858 | A | * | 7/1982 | Thomas et al. | 206/5.1 |
| 5,467,868 | A | * | 11/1995 | Abrams et al. | 206/5.1 |
| 5,697,495 | A | * | 12/1997 | Abrams et al. | 206/5.1 |
| 5,711,416 | A | * | 1/1998 | Bauman | 206/5.1 |
| 5,759,540 | A | * | 6/1998 | Nielsen | 134/901 |

FOREIGN PATENT DOCUMENTS

| | | |
|---|---|---|
| DE | 2527142 | 12/1976 |
| DE | 2707841 | 8/1978 |
| EP | 0223581 | 5/1987 |

* cited by examiner

*Primary Examiner*—Jim Foster
(74) *Attorney, Agent, or Firm*—Stout, Uxa, Buyan & Mullins, LLP; Frank J. Uxa

(57) ABSTRACT

A container including at most two first cavities for receiving an ophthalmic lens, and a second cavity for the removal of fluid from the or each first cavity, the second cavity being laterally spaced from, and in communication with, the or each first cavity, wherein each cavity has an opening on the same face of the container.

24 Claims, 3 Drawing Sheets

CONTAINER

This is a continuation of International Application PCT/GB98/02226, with an international filing date of Jul. 27, 1998.

The present invention relates to a container, in particular a container for an ophthalmic lens, more especially, a container for a hydrophilic or "soft" contact lens.

Packages for storing, transporting and dispensing soft contact lenses may comprise a container having a cavity in which the contact lens is housed in a saline solution.

EP-A-0 223 581 describes such a package. The base of the cavity has an inclined surface to aid removal of the lens.

EP-A-0 604 177 also describes such a package. The base of the cavity is concave, and has a radius of curvature which is greater than the radius of curvature of the lens, while being sufficiently small to cause the lens to settle at the lowermost portion of the base, i.e., to centre.

Soft contact lenses are generally manufactured by moulding. After moulding, the contact lens is subjected to various hydrating, washing and conditioning processes. In order to minimise handling of the lens, it is desirable to carry out those processes while the lens is in its final package, that is, while the lens is in the container. However, it is then necessary to be able to introduce and to remove treating fluids from the container without damaging the lens.

Fluid may be introduced to the cavity in which the lens is housed by directing the fluid into the centre of the upturned lens, and then allowing the fluid to overflow into the cavity. (Contact lenses are usually concavo—convex; in this specification a lens is described as "upturned" when its concave face is uppermost.) This method of fluid introduction avoids damage to the lens, and has the added advantage that it locates the lens at the base of the cavity, and prevents it from floating in the fluid.

Avoiding damage to the lens on fluid removal, however, is more difficult, particularly where the maximum diameter of the cavity is not much greater than the diameter of the lens. This will often be the case as it is desirable to minimise the size of the cavity in order to minimise manufacturing costs and production time, and to aid lens extraction by the user.

EP-A-0 618 063 describes a nozzle for removing fluid from a container containing a lens. The nozzle includes a fluid entrance passage and at least one fluid exit passage. The nozzle is placed in sealing contact with the container. Purging fluid is introduced to the container through the fluid entrance passage so that the fluid in the container is forced out through the fluid exit passage. The arrangement of the fluid entrance passage and the fluid exit passage is such that fluid flow is symmetrical about the central axis of the lens, so preventing migration of the lens from the centre.

It is an object of the present invention to provide a container which minimises or prevents damage to a lens on removal of fluid from the cavity housing the lens.

The present invention provides a container comprising at most two first cavities for receiving an ophthalmic lens, and a second cavity for the removal of fluid from the or each first cavity, the second cavity being laterally spaced from, and in communication with, the or each first cavity, wherein each cavity has an opening on the same face of the container.

Fluid removal is carried out by inserting a fluid removal device into the second cavity, either from above or from below, and then withdrawing fluid through the device. Insertion of the device in the second cavity avoids contact between the device and the or each lens, so reducing the possibility of damage to the or each lens. It will be appreciated that the second cavity may also be used to accommodate other devices used in the hydrating, washing or conditioning processes, for example, an ultrasonic probe to agitate the fluid, a device to heat the fluid, or a device to measure the fluid level.

The invention further provides a container comprising at most two first cavities for receiving an ophthalmic lens, and a second cavity for the removal of fluid from the or each first cavity, the second cavity being laterally spaced from, and in communication with, the or each first cavity, wherein each cavity has an opening, the openings being such that the cavities are capable of retaining fluid even when the openings are not sealed.

The invention further provides a container comprising at most two first cavities for receiving an ophthalmic lens, and a second cavity for the removal of fluid from the or each first cavity, the second cavity being laterally spaced from, and in communication with, the or each first cavity, wherein each cavity has an opening, the openings being such that the cavities form a closed system when the openings are sealed.

The invention further provides a container comprising at least one first cavity for receiving an ophthalmic lens, and a second cavity for the removal of fluid from the or each first cavity, the second cavity being laterally spaced from, and in communication with, the or each first cavity, wherein each cavity has an opening on one face of the container, the cross-sectional area of the opening of the or each first cavity being greater than that of the second cavity.

Soft contact lenses are subject to an inspection process as well as to hydrating, washing and conditioning processes. In the inspection process, an illuminating beam is transmitted through the lens. That beam is then focused on a screen to produce an image of the lens. That image is inspected (by eye or automatically) to determine whether or not the lens contains any irregularities which would make the lens unacceptable for consumer use.

In order to minimise handling of the lens, it is desirable to carry out the inspection process while the lens is in the container. Where that is the case, however, it is important to minimise the optical power of the base of the first cavity to minimise the effect that the container has on the illuminating beam. The base of the first cavity has zero optical power when it is flat. However, some curvature of the base is desirable to cause the lens to centre consistently. Accordingly, at least the lower portion of the inner wall of the or each first cavity is preferably concave.

The invention further provides a container comprising at least one first cavity for receiving an ophthalmic lens, and a second cavity for the removal of fluid from the or each first cavity, the second cavity being in communication with the or each first cavity, wherein at least a lower portion of the inner wall of the or each first cavity is concave.

Preferably, the second cavity is laterally spaced from the or each first cavity.

Where the lower portion of the inner wall of the first cavity is curved, it is desirable to maximise the radius of curvature of that portion to minimise the optical power of the base of the cavity. However, if the radius of curvature of the whole of the inner wall of the first cavity is such that it is just sufficient to cause the lens to centre, the first cavity would have to be extremely large in order to contain sufficient fluid to cover the lens. Accordingly, the inner wall of the or each first cavity advantageously comprises an upper portion and a lower portion, the radius of curvature of the lower portion being greater than the radius of curvature of the upper portion. This allows the first cavity to have a base of low optical power, while being able to contain sufficient fluid to cover the lens.

Preferably, the radius of curvature of the lower portion is between 9 mm and 35 mm. If the radius of curvature of the lower portion is less than 9 mm, the lens may not sit with its centre touching the centre of the lower portion. If the radius of curvature is greater than 35 mm, the lens may not centre.

Preferably, the radius of curvature of the upper portion is such that the maximum diameter of the or each first cavity is between 15 mm and 30 mm. A diameter that falls within this range allows sufficient volume for washing, while minimising package size.

Preferably, the depth of the or each first cavity is between 6 mm and 12 mm. A depth that falls within this range ensures that the entire lens will be covered by solution, while providing for the user the convenience of a shallow cavity.

Preferably, a channel provides the communication between the or each first cavity and the second cavity.

Efficiency of fluid removal will be greatest where the or each first cavity, the second cavity and the channel are all of equal depth. However, where this is the case, and the inner wall of the first cavity is concave, the channel walls will extend into the centre of the first cavity.

If the channel walls extend into the first cavity the discontinuity at their upper edges deflects an illuminating beam being transmitted through the base of the cavity. Such deflexion may be interpreted as being caused by an irregularity in the lens being inspected, particularly where the maximum diameter of the first cavity is not much greater than the diameter of the lens.

Accordingly, the diameter of the or each first cavity is preferably at least 15 mm where the bottom of the or each channel joins the or each first cavity. This diameter is slightly larger than the maximum diameter of a contact lens, and thus the channel walls will not extend far enough into the first cavity to cause any disturbance in the lens image during the inspection process.

The second cavity may be of any depth. Preferably, however, the depth of the second cavity is substantially the same as the depth of the or each first cavity.

If the diameter of the first cavity where the bottom of the channel joins the first cavity is as described above, and the inner wall of the first cavity is concave, then the depth of the channel where it joins the first cavity must be less than the depth of the first cavity. Although the depth of the channel where it joins the first cavity is advantageously less than the depth of the first cavity, the rest of the channel may be of any depth, for example, it may be of the same depth as where the channel joins the first cavity. Preferably, however, the bottom of the or each channel slopes downward from the or each first cavity to the second cavity.

In certain embodiments, the side walls of the or each channel are curved. In other embodiments, the side walls of the or each channel are straight.

The width of at least a portion of the or each channel may be less than the width of the second cavity. For example, where the side walls of the channel are curved, they may provide a constriction midway along the channel's length. Alternatively, where the side walls of the channel are straight, the channel may be narrower than the second cavity, thus providing a constriction along the whole of the channel's length.

The width of at least a portion of the or each channel may be approximately equal to the width of the second cavity. For example, the side walls of the channel may be straight and of the same width as the second cavity, thus minimising fluid velocity through the channel, and reducing the likelihood of the lens being pulled into the channel.

Preferably, the minimum width of the or each channel is between 3 mm and 6 mm. A width within this range is great enough to permit fluid to flow sufficiently rapidly between the first and second cavities when the fluid removal device is in operation, while preventing the lens from becoming wedged in the channel during or after processing.

The second cavity may be of any diameter, provided that it is sufficiently wide to receive the fluid removal device. Preferably, the diameter of the second cavity is as small as possible so as to minimise the size of the container, and thus minimise manufacturing costs.

Preferably, the container comprises a flange which surrounds the cavities. The flange provides a convenient grip for the user on opening the package, and a surface on which to seal a cover for the first and second cavities once a lens has been treated and inspected, and is housed in saline solution, ready for use. To gain access to the lens, the user peels the cover off the resulting package.

Advantageously, the flange comprises a finger or thumb tab. This is a depressed portion of the flange, adapted to receive a finger or a thumb. The finger or thumb tab provides enhanced grip for the user, and is particularly useful when the package is being opened in a wet environment. Preferably, the depth of the thumb tab is such that it provides a support for the container. This will improve the stability of the container.

Alternatively, or in addition, the flange may comprise one or more grips. The grips provide resistance to slippage, and, again, are particularly useful where the package is being opened in a wet environment. Preferably, grips are provided on the finger or thumb tab. Advantageously, grips are provided on both sides of the finger or thumb tab.

Preferably, the container comprises a protector ring on the outer wall of the or each first cavity. Any damage to the outer wall of the first cavity will affect the inspection process. The protector ring reduces such damage. Advantageously, the free edge of the protector ring is substantially planar. The protector ring then provides a flat surface for the container to rest on so improving the stability of the container.

The container is advantageously of plastics material. The container may be made by injection moulding or thermoforming. The plastics material may be, for example, polyethylene, polypropylene or polystyrene. Depending on the type and grade of plastics material selected, the container may be opaque, translucent or, preferably, transparent in view of the desirability of inspection of the lens in the container, as described above. The container may be made of a single material or a multi-layer material so allowing optimisation of the interior and exterior surfaces of the container according to function.

Preferably, the inner wall of the or each first cavity comprises a meniscus control means. The meniscus control means alters the effect of surface tension between the inner wall of the first cavity and fluid in the first cavity to prevent the meniscus of the fluid from interfering in the inspection process. The meniscus control means may comprise an alteration in the surface of the inner wall of the first cavity, for example, treating the surface by flame, corona or chemical treatment, altering the texture of the surface, or including a geometric pattern in the surface.

The present invention also provides a package for an ophthalmic lens comprising a container, the container comprising at least one first cavity for receiving an ophthalmic lens, and a second cavity for the removal of fluid from the or each first cavity, the second cavity being in communication with the or each first cavity, wherein each cavity has an opening, and the openings are sealed with a releasable film.

The present invention further provides a multi-pack for storage of a plurality of ophthalmic lenses comprising a plurality of containers, each container comprising at least one first cavity for receiving an ophthalmic lens, and a second cavity for the removal of fluid from the or each first cavity, the second cavity being in communication with the or each first cavity, wherein each cavity has an opening, and the openings of other containers sealed with a releasable film.

The multi-pack may contain, for example, seven containers for one week's supply of daily disposable lenses.

The present invention further provides the use of a container for inspection, processing and storage of an ophthalmic lens, the container comprising at least one first cavity for receiving an ophthalmic lens, and a second cavity for the removal of fluid from the or each first cavity, the second cavity being in communication with the or each first cavity.

By way of example only, embodiments of the invention will now be described in greater detail with reference to the accompanying drawings, of which:

Figure 1:
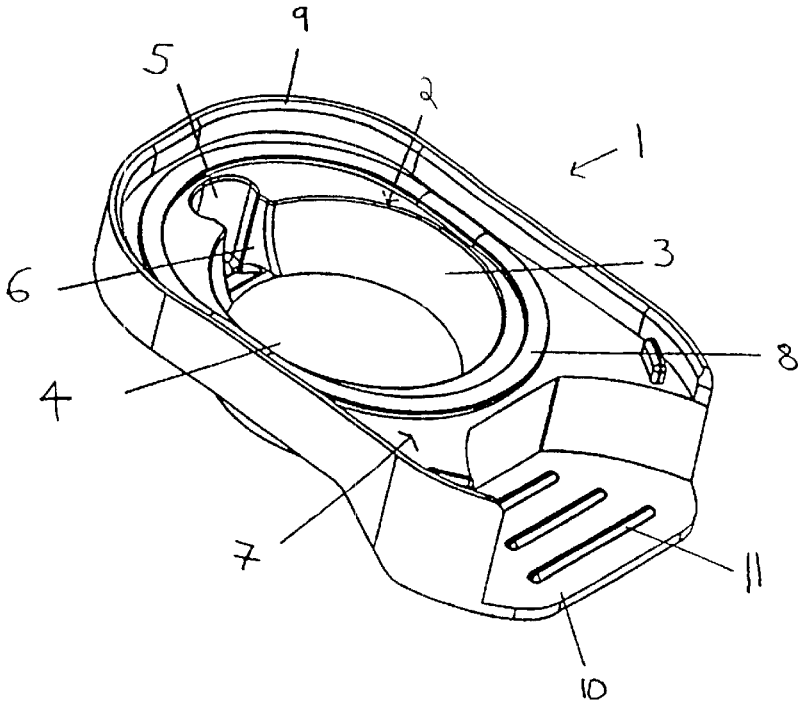
FIG. 1 shows an isometric view of a first container constructed according to the invention.
Figure 2:
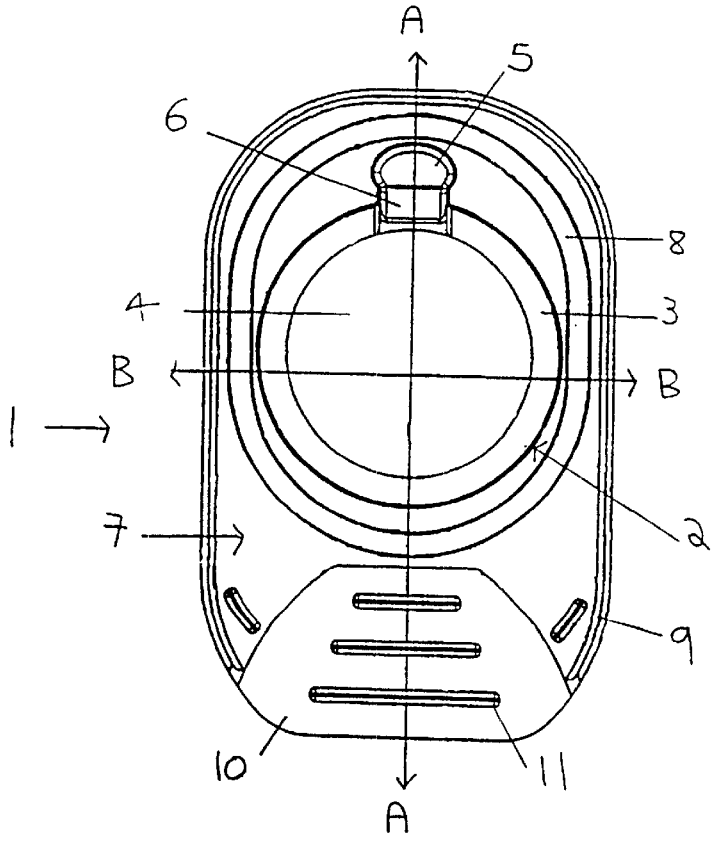
FIG. 2 shows a plan view of the container of FIG. 1.

Referring more especially to FIGS. 1 to 4, a container indicated generally by the reference numeral 1 comprises a first circular cavity 2 for receiving a soft contact lens. The first cavity 2 is of compound radius, comprising an upper portion 3 and a lower portion 4.

The container 1 also comprises a second, elliptical cavity 5, and a channel 6 which connects the second cavity 5 with the first cavity 2. The depth of the second cavity 5 is the same as the maximum depth of the first cavity 2. The channel 6 extends into only the upper portion 3 of the first cavity 2, the bottom half of channel 6 sloping downward from the first cavity 2 to the second cavity 5. The side walls of the channel 6 are straight, and the channel 6 is narrower than the second cavity 5.

The container 1 further comprises a flange indicated generally by the reference numeral 7 comprising a raised sealing rim 8 around the circumference of the first cavity 2 and second cavity 5, and an upstanding outer rim 9 around the circumference of the flange 7. The container 1 also comprises a depressed thumb tab 10 having a plurality of ribs 11, and a protector ring 12 underlying the first cavity 2. A film (not shown) may be heat sealed to the sealing rim 8 to form a hermetically sealed blister package. The rim 9 stiffens the edge of the flange 7, and allows the use of thinner material for the rest of the container, as well as protecting the package in automated handling. The thumb tab 10 provides a grip for the consumer. A number of ribs (grips) 11 are provided on the upper and lower surfaces of the thumb tab 10. The two sets of ribs improve the grip provided by the tab to the user, and the lower ribs co-operate with the planar free edge of the protector ring 12 to provide a flat and stable means for storing and transporting the container.

The rim 9 and other parts of the container have rounded edges to ease conveyance, and reduce jamming or bridging in automated handling. The container 1 may include index marks for use in electronic vision systems, and may be labelled or otherwise coded.

Figure 5:
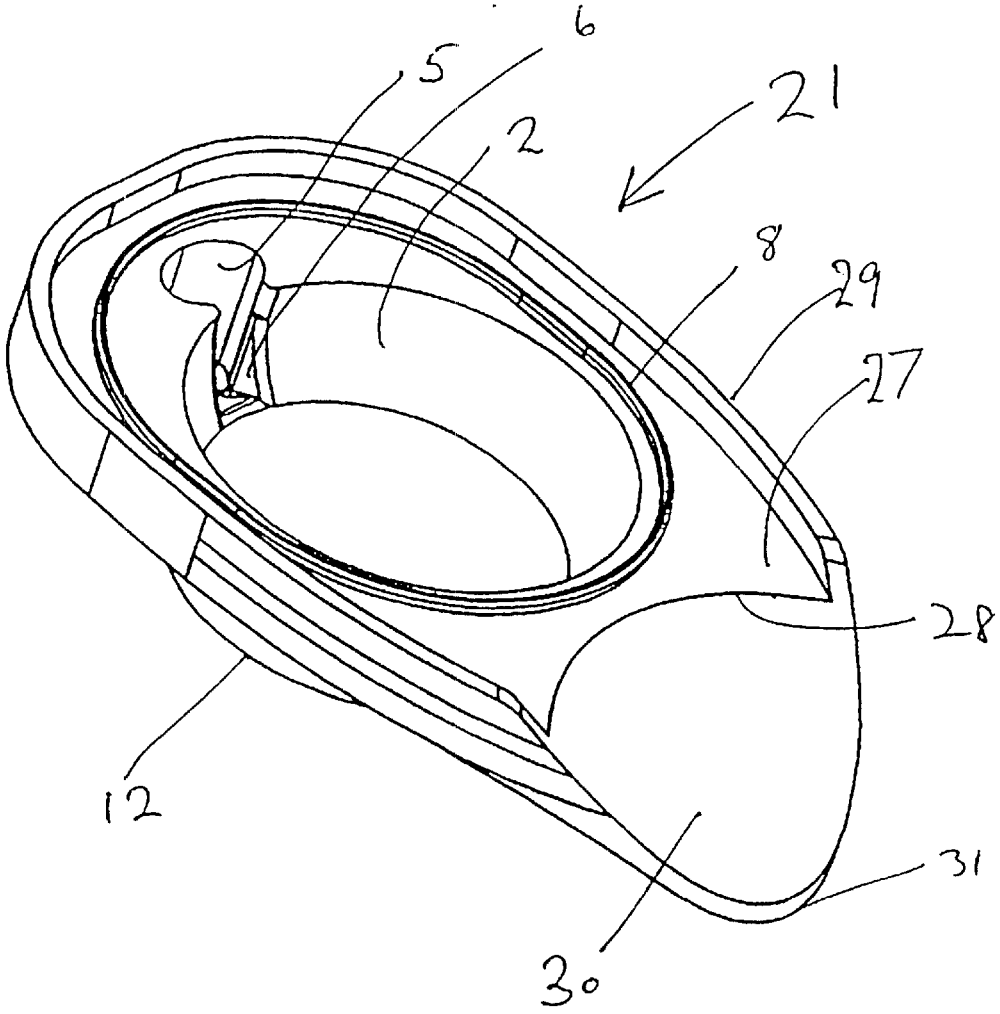
FIG. 5 shows an isometric view of a second container constructed according to the invention.

Referring now more especially to FIG. 5, in which parts corresponding to those of the first embodiment are denoted by the same reference numerals, a second container, indicated generally by the reference numeral 21, has cavities 2 and 5, connecting channel 6, sealing rim 8 and protector ring 12, like those of the container 1. An outer rim 29 and flange 27 are shaped differently from the corresponding features of the container 1, however, the flange narrowing gradually from a location beside the centre of the first cavity 2, the outer rim 29 being correspondingly curved from that location, the flange terminating in a concave portion 28, at the extremities of which the rim 29 terminates. A flat thumb tab 30 slopes down from the concave portion 28, a free edge 31 of the tab 30 being at the level of the edge of the protecting ring 12.

Figure 3:
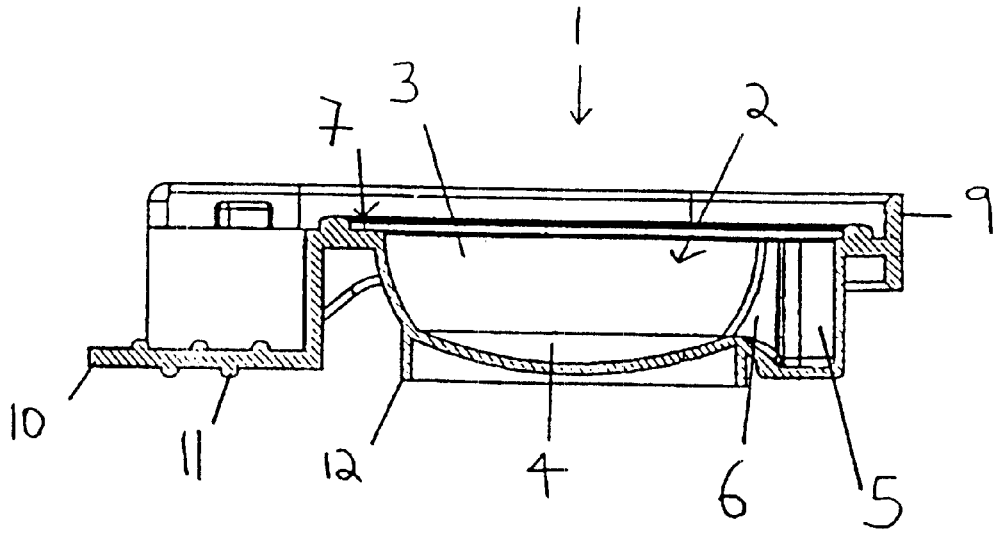
FIG. 3 shows a section along line A—A of FIG. 2.
Figure 4:
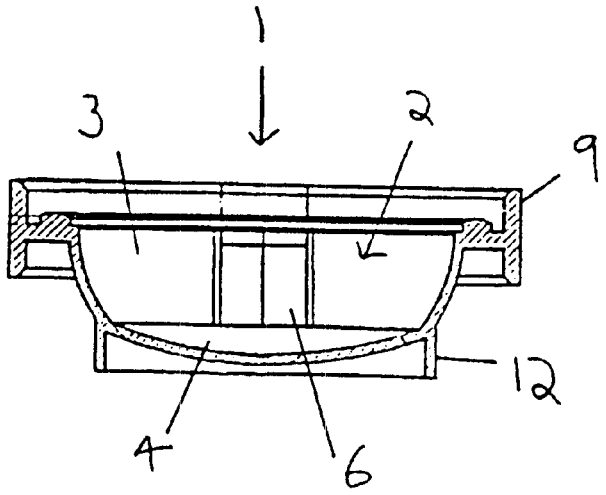
FIG. 4 shows a section along line B—B of FIG. 2.
Figure 6:
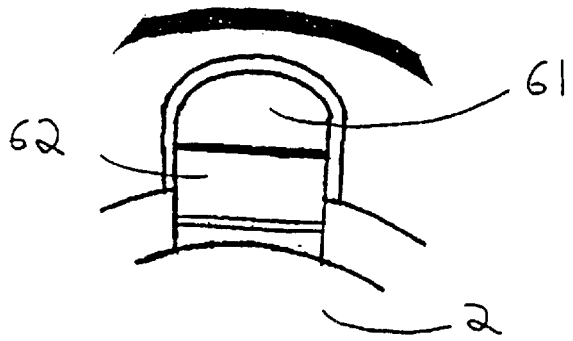
FIG. 6 shows a plan view of a detail of a third container constructed according to the invention.

Referring now more especially to FIG. 6, there is shown in plan view a part of a third container comprising a second cavity 61 and the adjoining segment of a first cavity 2. In this embodiment, the channel 62 and the cavity 61 are of the same width, the base (not shown) of the channel 62 sloping down from the first cavity 2 to the second cavity 61 as illustrated in FIG. 3 with reference to the first embodiment. The wider channel, in comparison with those of the first and second embodiments, provides a lower fluid velocity through the channel when fluid is being removed at a given rate, thereby reducing the likelihood of the lens being pulled into the channel.

The dimensions of a typical container may be, for example, approximately as follows:

| | |
|---|---|
| height of container 1 | 11 mm |
| maximum depth of first cavity 2 | 7 mm |
| radius of curvature of upper portion 3 | 9 mm |
| radius of curvature of lower portion 4 | 25 mm |
| maximum diameter of upper portion 3 | 22 mm |
| depth of second cavity 5 | 7 mm |
| maximum diameter of second cavity | 6 mm |
| depth of channel 6 | 5.5 mm |
| minimum width of channel 6 | 5 mm |
| diameter of first cavity 2 where it joins channel 6 | 18 mm |

The first cavity 2 holds approximately 2 ml of fluid.

What is claimed is:

1. A package for storage of an ophthalmic lens, the package comprising a container which comprises at least one first cavity containing a fluid and an ophthalmic lens, a second cavity having a depth substantially the same as a depth of the at least one first cavity for the removal of the fluid from the at least one first cavity, and a channel to provide communication between the at least one first cavity and the second cavity, the channel having a bottom sloping downward from the at least one first cavity to the second cavity, wherein the at least one first cavity has a diameter of at least 15 mm where the channel joins the at least one first cavity and each cavity has an opening and the openings are sealed with a releasable film.

2. A package for storage of an ophthalmic lens, the package comprising a container which comprises at least one first cavity containing a fluid and an ophthalmic lens, a second cavity for the removal of the fluid from the at least one first cavity, and a channel to provide communication between the at least one first cavity and the second cavity, the channel having a curved sidewall and at least a portion of the channel having a width approximately equal to a width of the second cavity, wherein each cavity has an opening and the openings are sealed with a releasable film.

3. A package for storage of an ophthalmic lens, the package comprising:

a container including at least one first cavity sized for containing an ophthalmic lens and a fluid, the at least one first cavity having an inner wall comprising an upper portion and a lower portion, at least the lower portion of the inner wall being concave, a second cavity in fluid communication with the at least one first cavity, the second cavity being smaller in size than the at least one first cavity and being structured to facilitate fluid removal from the container, and a channel fluidly connecting the at least one first cavity and the second cavity, the channel having a minimum width between 3 mm and 6 mm.

4. A package for storage of an ophthalmic lens, the package comprising:

a container including at least one first cavity containing an ophthalmic lens and a fluid, a second cavity in fluid communication with the at least one first cavity, the second cavity being smaller in size than the at least one first cavity and being structured to facilitate fluid withdrawal from the container, and a releasable film sealing the at least one first cavity and the second cavity.

5. The package of claim 4 wherein the second cavity is structured to accommodate a device for withdrawing fluid.

6. The package of claim 4 wherein the second cavity is structured to accommodate a device for processing fluid within the container.

7. The package of claim 4 wherein the container further includes a channel fluidly connecting the at least one first cavity and the second cavity.

8. The package of claim 7 wherein the channel has a width about equal to the diameter of the second cavity.

9. The package of claim 7 wherein the channel includes a width sized to minimize fluid velocity through the channel upon fluid withdrawal from the second cavity.

10. The package of claim 4 wherein the container comprises at most two first cavities.

11. The package of claim 4 wherein the container includes a face and the at least one first cavity and the second cavity each include an opening on the face of the container.

12. The package of claim 11 wherein the opening of the second cavity is laterally spaced from the opening of the at least one first cavity.

13. The package of claim 11 wherein the opening of the at least one first cavity has a cross-sectional area greater than a cross-sectional area of the opening of the second cavity.

14. The package of claim 11 wherein the openings are such that the cavities form a closed system when the openings are sealed.

15. The package of claim 11 wherein the openings are sealed with the releaseable film disposed across the face of the container.

16. The package of claim 4 wherein the at least one first cavity has an inner wall comprising an upper portion and a lower portion, at least the lower portion of the inner wall being concave.

17. The package of claim 16 wherein the lower portion has a radius of curvature greater than a radius of curvature of the upper portion.

18. The package of claim 7 wherein the at least one first cavity has a diameter of at least 15 mm where the channel joins the at least one first cavity.

19. The package of claim 4 wherein the second cavity has a depth substantially the same as a depth of the at least one first cavity.

20. The package of claim 7 wherein the channel has a bottom sloping downward from the at least one first cavity to the second cavity.

21. The package of claim 7 wherein at least a portion of the channel has a width less than a width of the second cavity.

22. The package of claim 4 wherein the at least one first cavity has an outer wall, and the container comprises a protector ring on the outer wall of the at least one first cavity.

23. The package of claim 4 wherein the at least one first cavity has an inner wall comprising a meniscus control means.

24. A multi-pack for storage of a plurality of ophthalmic lenses, the multi-pack comprising a plurality of containers in close proximity, each container comprising at least one first cavity containing a fluid and an ophthalmic lens, and a second cavity being in communication with the at least one first cavity, and the second cavity being smaller in size than the at least one first cavity, wherein each of the cavities include a sealed opening on one side of the container.

* * * * *